350-332 SR
XR 3,981,004
TX 3104 N

United States
Shimizu et al.

11] 3,981,004
45] Sept. 14, 1976

[54] DEVICE FOR APPLYING AN A.C. VOLTAGE WITHOUT D.C. COMPONENT TO A LIQUID CRYSTAL DISPLAY PANEL

[75] Inventors: Kazuhiko Shimizu, Osaka; Kenichi Suenami, Neyagawa, both of Japan

[73] Assignee: Matsushita Electric Industrial Co., Ltd., Osaka, Japan

[22] Filed: Nov. 15, 1974

[21] Appl. No.: 524,213

[30] Foreign Application Priority Data

Nov. 20, 1973 Japan ..... 48-134427[U]

[52] U.S. Cl. ..... 340/336; 340/324 M; 350/160 LC

[51] Int. Cl.[2] ..... G09F 9/32

[58] Field of Search ..... 340/324 M, 166 EL, 336; 315/169 TV; 350/160 LC

[56] References Cited

UNITED STATES PATENTS

| | | | |
|---|---|---|---|
| 3,532,813 | 10/1970 | Lechner | 350/160 LC |
| 3,786,485 | 1/1974 | Wojcik | 340/324 M |
| 3,877,017 | 4/1975 | Kawakami et al. | 340/166 EL |

*Primary Examiner*—Marshall M. Curtis
*Attorney, Agent, or Firm*—Stevens, Davis, Miller & Mosher

[57] ABSTRACT

The present invention relates to an A.C. drive device for a liquid display panel in which liquid crystal layers are interposed between opposing segments across which an A.C. voltage is selectively applied to selectively drive the liquid crystal layers for displaying desired numerals, characters or the like. Clamp circuits are provided to prevent a D.C. voltage component from being applied to the liquid crystal layers when any selected character or numeric is to be displayed. This serves to extend the durability of the liquid crystal.

3 Claims, 4 Drawing Figures

3981004
OR IN 340/336

DEVICE FOR APPLYING AN A.C. VOLTAGE WITHOUT D.C. COMPONENT TO A LIQUID CRYSTAL DISPLAY PANEL

The present invention relates to an A.C. drive device for a liquid crystal display panel in which liquid crystal layers are interposed between opposing segments across which an A.C. voltage is selectively applied to selectively drive the liquid crystal layers for displaying desired characters, numerals or the like.

It is an object of the present invention to prevent a D.C. voltage component from being applied to the liquid crystal so that the durability of the liquid crystal can be extended. Usually, when a D.C. voltage is applied to the liquid crystal, it becomes inoperative. According to the present invention, an A.C. voltage completely free of a D.C. component is applied to the liquid crystal even when the components constituting a drive circuit for the liquid crystal display panel have mismatched characteristics or performances, whereby the durability of the liquid crystal is extended.

According to the present device, the circuit construction is simplified and the driving voltage can be increased to a value as high as the breakdown limit of the transistors used. Furthermore, since no D.C. voltage component is applied to the liquid crystal long durability and a display of high contrast are assured.

The above and other objects, features and advantages of the invention will become more apparent from the following detailed description of preferred embodiments of the invention when taken in conjunction with the accompanying drawing, in which.

Figure 1:
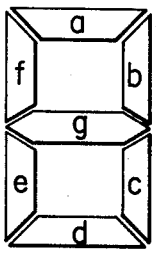
FIG. 1 PRIOR ART
FIG. 1 is a view showing a segment configuration used to display numerals.

Referring to FIG. 1, there is shown a segment configuration for one digit arranged in a liquid crystal display panel. As shown therein, the liquid crystal display panel consists of separated segments (a) through (g), a common segment arranged on the back of the segments (a) through (g), and liquid crystal layers interposed between the segments (a) through (g) and the common segment.

Figure 2:
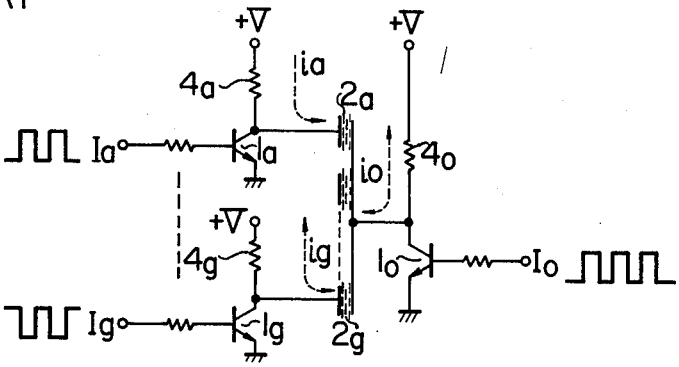
FIG. 2 PRIOR ART
FIG. 2 is a circuit diagram showing a prior art drive circuit for a liquid crystal display panel.

Referring now to FIG. 2, there is shown a drive circuit for the liquid crystal display panel, which is represented by;

A. a drive circuit in which, as shown in FIG. 2, when the A.C. voltages applied to the input terminals $I_a$ to $I_g$ of the transistors $I_a$ to $I_g$ having their respective collectors connected to the segments $a - g$ are in phase with an A.C. voltage applied to an input terminal $I_o$ of a transistor $1_o$, the liquid crystal layers $2_a$ to $2_g$ are not scattered, and when an A.C. voltage applied to the input terminal $I_a$ only is out of phase with respect to the A.C. voltage applied to the input terminal $I_o$, current flows through the liquid crystal layer $2_a$ in alternating directions so that the crystal layer $2_a$ is scattered, B. a drive circuit in which a transistor and a load are constructed by a pair of complementary transistors to reduce overall power consumption (note that in the circuit shown in FIG. 2 the load resistors $4_o$, $4_a$ to $4_g$ consume much more power than the liquid crystal consumes.), and C. a drive circuit in which the frequency of the A.C. voltage applied to the liquid crystal layer is selected to be low when it is to be scattered and selected to be high when it is not to be scattered.

As described above, various drive devices for the liquid crystal have been suggested. In the device C above, however, due to the fact that the liquid crystal layer is a kind of capacitor the power consumption increases as the frequency of the drive voltage is increased. In the device B above, although a so-called C-MOS (Complementary Metal Oxide Semiconductor) device may be satisfactorily used, the maximum operating voltage of the presently available device is 15 volts, which does not allow the use of sufficient voltage to drive a large size liquid display panel. In addition, the use of complementary transistors renders the circuit complex.

Figure 3:
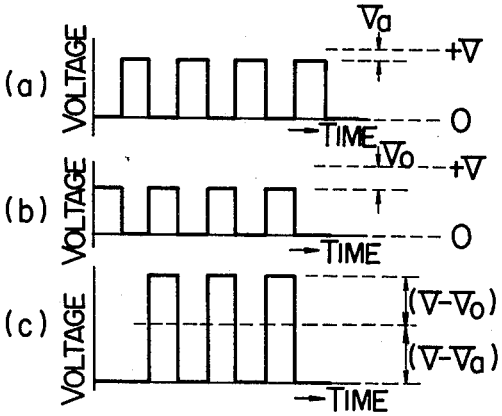
FIG. 3 PRIOR ART
FIG. 3 is a diagram showing voltage waveforms for the liquid crystal layer of FIG. 1.

Furthermore, the device A above has the following disadvantages; When a liquid crystal is used to display a numeral, there exist liquid crystal layers $2_a$ to $2_g$, shown in FIG. 2, between the respective segments $a$ to $g$ and the common electrode (not shown). The segments $a$ to $g$ are connected to the transistors $1_a$ to $1_g$, respectively while the common electrode is connected to the collector of the transistor $1_o$. Assuming that the transistors $1_a$ to $1_g$ and $1_o$ are all identical, the load resistors $4_a$ to $4_g$, $4_o$ are all identical and the segments $a$ to $g$ all have the same area, when the A.C. voltages is applied to the input terminal $I_a$ to $I_g$ in a phase opposite to that of the A.C. voltage applied to the input terminal $I_o$ in order to generate a $\theta$-like segmented character, currents as shown in FIG. 2 flow through the load resistors $4_a$ to $4_g$ and $4_o$ and the liquid crystal layers $2_a$ to $2_g$. It is apparent from the above assumption that $i_a = \ldots = i_g$ and $i_o = 7i_a$. Thus, the voltage across the segment $a$ is lower by the voltage drop $V_a$ across the load resistor $4_a$, (a similar relation is applicable to other segments.), as shown by waveform a in FIG. 3. Similarly, the voltage across the common electrode is lower by $V_o$, as shown by waveform $b$ in FIG. 3, where $V_o = 7 \times V_a$. Thus, the voltage as shown by waveform $c$ in FIG. 3 is applied across the liquid layer $2_a$, which causes the durability of the liquid crystal to be extremely short. In order to overcome the above difficulty, if one sets the value of the load resistor $4_o$ for the common electrode to one seventh (1/7) of the values of the load resistors $4_a$ to $4_g$ for the segments $a$ to $g$, an A.C. voltage completely free of D.C. component can be produced for displaying the digit 8. However, when other digits are to be displayed, the above one seventh resistor value would result in a D.C. component. Thus, in order to obtain a complete A.C. voltage the value of the resistor must be changed to various values each calculated for the respective one of the digits 0 to 9. This is practically impossible. Although in the above explanation it was assumed that the transistors were all identical, the load resistors were all identical and the segments had all identical area, actually there exist mismatches in their characteristics and performances. Thus it is practically impossible in the circuit shown in FIG. 2 to apply an A.C. voltage completely free of a D.C. component to the liquid crystal layer and hence the durability of the liquid crystal is short.

The present invention is intended to overcome the above difficulties encountered in the prior art devices. A preferred embodiment of the present invention will now be described in conjunction with FIG. 4 in which the same reference numbers are used to identify the same or corresponding parts.

Figure 4:
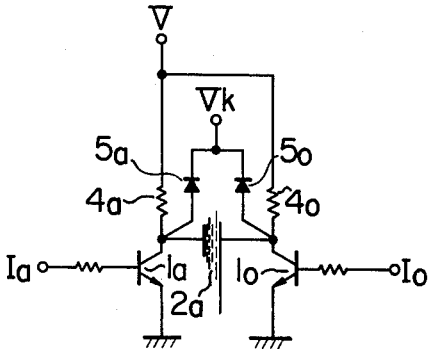
FIG. 4 is a circuit diagram showing a principal portion of a drive circuit in accordance with the present invention.

Referring to FIG. 4, there are provided diodes 5-a and 5-o which have their anodes connected to the collectors of the transistors $1_a$ and $1_o$ respectively and have their cathodes commonly connected to a voltage source of $V_k$ to clamp the voltage across the liquid crystal layer $2_a$ to the voltage $V_k$. While the circuit for the segment *a* is illustrated as representative, it should be understood that the circuits for other segments similarly include diodes connected to the voltage source of $V_k$. Now, by establishing a relation of $V - V_k \geqq V_{max}$, where $V_{max}$ is the largest one of the voltage drops $V_a$ to $V_g$ and $V_o$ across the load resistors of the respective transistors, the voltage waveform applied to the liquid crystal layer $2_a$, shown by waveform c in FIG. 3 would be $V - V_o = V - V_a = V_k$, which shows that a complete A.C. voltage would be applied to the liquid crystal layer $2_a$.

The ground for establishing the above condition, i.e. $V - V_{max} \geqq V_k$ or $V - V_k \geqq V_{max}$ will now be described with reference to FIGS. 3 and 4. In the waveform c shown in FIG. 3 which results from the waveforms a and b shown in FIG. 3, the height thereof above a dotted center line and that below the center line are not equal and hence it is not a complete A.C. waveform. When both heights are equal, a complete A.C. waveform will result. To do this, it is necessary to cut a top portion of the higher waveform in half. In the illustrated example shown by c in FIG. 3, it is necessary to cut by the amount of $(V - V_a) - (V - V_o) = V_o - V_a$. Since the supply voltage V minus the maximum voltage drop $V_{max}$, i.e. $V - V_{max}$ is the smallest voltage applied to the electrodes, by setting the value of $V_k$ smaller than $V - V_{max}$, the voltage $V - V_x$, which is larger than $V_k$, can be bypassed through the diodes.

While the preferred embodiment of the present invention has been described and shown as having a clamp circuit constructed by the diodes, it should be understood that the diode clamp circuit is not a restrictive illustration but any other means can be substituted to implement the present invention.

What we claim is:

1. An A.C. drive device for a liquid crystal display panel including a plurality of separated segments, a common segment facing said plurality of segments and liquid crystal layers interposed between said plurality of segments and said common segment, said liquid crystal display panel displaying characters, numerals or the like by the scatter in the liquid crystal layer corresponding to a selected one of said plurality of segments when an A.C. voltage applied to said selected segment is out of phase with respect to an A.C. voltage applied to said common segment, said drive device comprising a clamp circuit to clamp the voltages applied to said plurality of segments and said common segment to a predetermined fixed voltage thereby preventing a D.C. component from appearing in said applied voltage.

2. An A.C. drive device for a liquid crystal display panel comprising a liquid crystal display panel including a plurality of separated segments, a common segment facing said plurality of segments and liquid crystal layers interposed between said plurality of segments and said common segment, and a plurality of transistors having their respective collectors connected to said plurality of segments and said common segment, said collectors being supplied with D.C. voltage through their respective load resistors, the bases of said transistors being selectively supplied with an A.C. voltage for driving a corresponding liquid crystal layer, characterized in that clamp circuits are connected to each of said plurality of segments and said common segment, said clamp circuits preventing a D.C. component from appearing in said applied voltage.

3. An A.C. device for a liquid crystal display panel as defined in claim 2 wherein said clamp circuits are constructed by diodes.

* * * * *